US005309973A

United States Patent [19]

Huang

[11] Patent Number: 5,309,973

[45] Date of Patent: May 10, 1994

[54] CURTAIN CARRIER SLIDE STRUCTURE

[76] Inventor: Su-Chin Huang, No. 46, Lane 315, Hwahsing St., Chu-Pei City, Hsinchu Hsien, Taiwan

[21] Appl. No.: 77,247

[22] Filed: Jun. 14, 1993

[51] Int. Cl.[5] ..... A47H 1/00

[52] U.S. Cl. ..... 160/126; 160/345

[58] Field of Search ..... 160/126, 123, 124, 330, 160/341, 344, 345, 346; 16/87 R, 87.2, 87.4 R, 94 D, 95 D, 96 D

[56] References Cited

U.S. PATENT DOCUMENTS

| | | | |
|---|---|---|---|
| 3,361,191 | 1/1968 | Goble | 160/345 |
| 3,513,900 | 5/1970 | Ronfola | 160/126 |
| 4,112,995 | 9/1978 | Pasinski | 160/126 |
| 4,240,489 | 12/1980 | Madsen | 160/126 |
| 4,355,677 | 10/1982 | Madsen | 160/126 |
| 4,881,588 | 11/1989 | Madsen | 160/126 X |

*Primary Examiner*—David M. Purol

*Attorney, Agent, or Firm*—Poms, Smith, Lande & Rose

[57] ABSTRACT

A curtain carrier slide structure comprises a hollow body with open top and bottom sides to slidably receive therein a slidable block which is biased by springs toward the top side of the hollow body The carrier slide is slidably mounted on a track to movable therealong. The hollow body comprises two opposite end walls each having an upper recess and a lower recess formed thereon. A bead string having a number of beads secured thereon along the length thereof to define a number of bead gaps between the beads is received within the lower recess to have the end walls of the hollow body engagingly received in the bead gaps so as to have the carrier slide engage the bead string to move therewith along the track. A release block which is receivable within the upper recesses of the hollow body is securely mounted on the track so that when the hollow body is moved to pass over the release block, the release block enters the upper recess to push the slidable block against the biasing spring toward the open lower end so as to break the engagement between the bead string and the hollow body, thus allowing the hollow body to be retained by the release block and no longer movable with the bead string.

2 Claims, 5 Drawing Sheets

CURTAIN CARRIER SLIDE STRUCTURE

FIELD OF THE INVENTION

The present invention relates generally to a curtain, such as a window covering, and in particular to a curtain carrier slide structure.

BACKGROUND OF THE INVENTION

Window coverings are widely used to cover windows. The window covering generally comprises a rod or a track traversing the width of a window with a number of carrier slides slidably mounted thereon. Curtains or vertical slats are fixed to the carrier slides to be movable by the carrier slides. Cords or strings are secured to the carrier slides to allow a person to control the movement of the carrier slides in order to open or close the curtains.

Conventionally, a window covering assembly may have two pieces of curtains each of which is substantially fixed at one of the side jambs of the window and is slidably movable toward each other to meet at a central portion of the window. Such a conventional design only allows the curtains to move from the lateral sides of the window to the center thereof when closing the curtains It is not possible for such a conventional curtain assembly to allow the curtains to be closed by moving from the center of the window to the lateral sides thereof.

Similarly, in opening the curtains, it is also impossible for the conventional curtain assembly to move from the lateral sides of the window to converge to the center of the window. The conventional design of curtain assembly only allows the curtains to separately converge to the opposite lateral sides of the windows.

It is therefore desirable to provide a curtain carrier slide structure which allows the curtains to be moved either from the lateral sides to the center of a window or from the center to the lateral sides of the window.

SUMMARY OF THE INVENTION

It is therefore the principal object of the present invention to provide a curtain carrier slide structure which allows the curtains to be movable both from the center of a window to the lateral sides thereof and from the lateral sides to the center and thus allowing the curtains to converge to both the lateral sides and the center of the window.

It is also an object of the present invention to provide a curtain assembly which allows the curtains to be moved in either direction to close/open the curtains in either direction.

To achieve the above object, there is provided a curtain carrier slide structure comprising a hollow body with open top and bottom sides to slidably receive therein a slidable block which is biased by springs toward the top side of the hollow body. The carrier slide is slidably mounted on a track to movable therealong. The hollow body comprises two opposite end walls each having an upper recess and a lower recess formed thereon. A bead string having a number of beads secured thereon along the length thereof to define a number of bead gaps between the beads is received within the lower recess to have the end walls of the hollow body engagingly received in the bead gaps so as to have the carrier slide engage the bead string to move therewith along the track. A release block which is receivable within the upper recesses of the hollow body is securely mounted on the track so that when the hollow body is moved to pass over the release block, the release block enters the upper recess to push the slidable block against the biasing spring toward the open lower end so as to break the engagement between the bead string and the hollow body, thus allowing the hollow body to be retained by the release block and no longer movable with the bead string.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
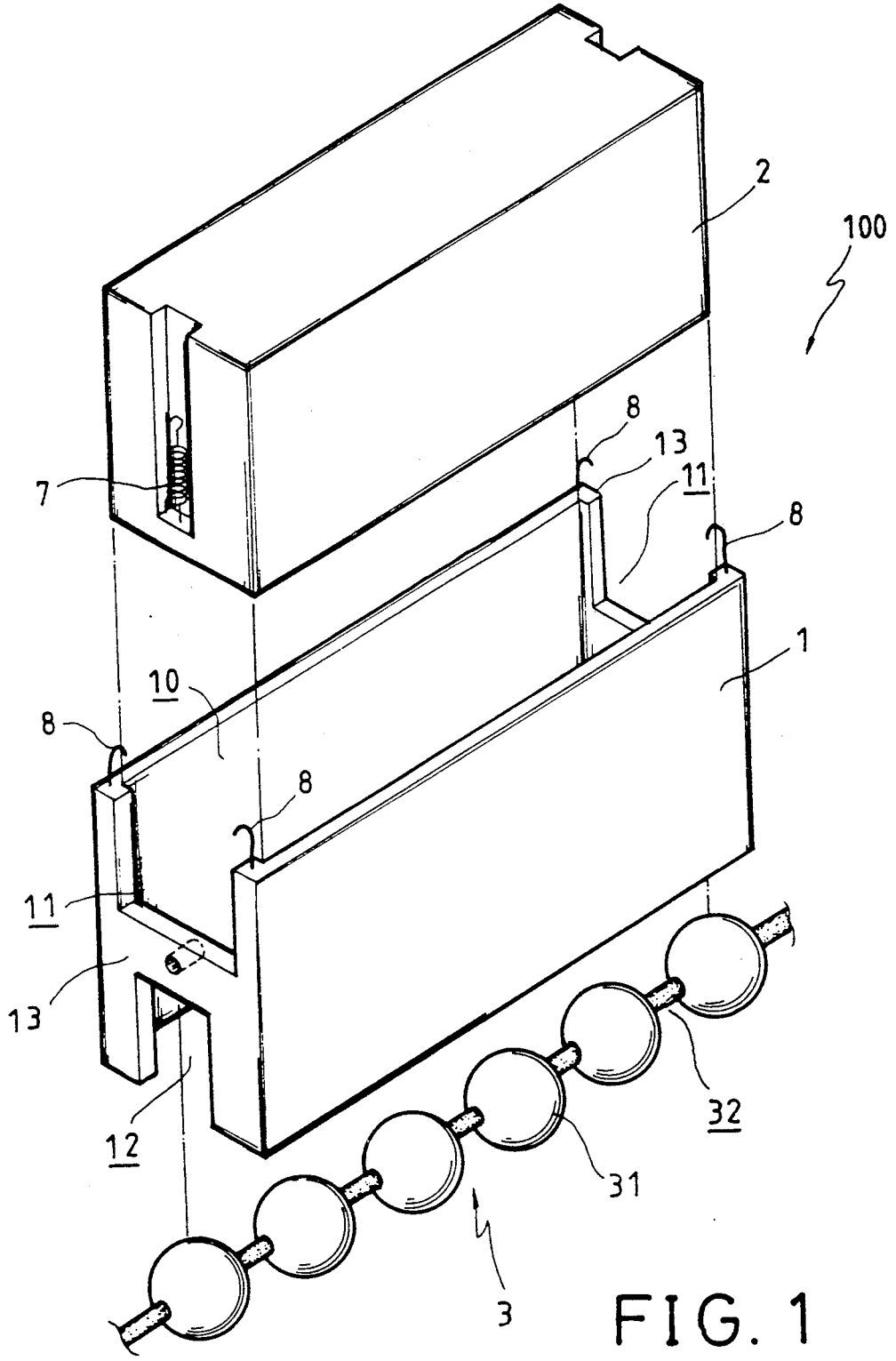
FIG. 1 is an exploded perspective view showing a curtain carrier slide structure constructed in accordance with the present invention.

With reference to the drawings and in particular to FIG. 1, wherein a curtain carrier slide constructed in accordance with the present invention, generally designated by the reference numeral 100, is shown in an exploded form, the curtain carrier slide 100 comprises a hollow body 1 which is open at both the top and bottom sides thereof to define therein an open interior space 10 for slidably receiving therein a slidable block 2. Biasing means, such as spring 7, is mounted between the slidable block 2 and the hollow body 1 to bias the slidable block 2 to the top side of the hollow body 1.

Preferably, two springs 7 are mounted on the opposite ends of the slidable block 2 to bias the slidable block 2 in a force balance manner. This can be observed in FIGS. 2–5, but only one of the springs 7 is visible in FIG. 1.

The hollow body 1 comprises at the top side thereof a number of engaging means, such as hook-like members 8 shown in FIG. 1, to slidably engage an elongated traverse rod or track 4 (see FIGS. 2–5) and to be guided thereby. This is known to those having ordinary skill in the art of window coverings and thus no detail is needed herein.

The hollow body 1 has two opposite end walls 13 on each of which an upper recess 11 and a lower recess 12 are formed. An elongated bead string 3 is received within the lower recesses 12 and extending therebetween and outward therefrom. The bead string 3 comprises therealong a number of substantially equally-spaced beads 31 to define therebetween a number of gaps 32 which is large enough to receive the end walls 13 therein when the bead string 3 is received within the lower recesses 12 so as to drive the hollow body 1 to move along the track 4 when the bead string 3 is pulled.

With reference to FIGS. 2-5, wherein a curtain assembly, generally designated by the reference numeral 200, is shown in different conditions, the curtain assembly 200 comprises at least a curtain 6, preferably two as illustrated, and each of the curtains 6 is slidably hung on the track 4 via a number of carrier slides 100, for example two as shown in the drawings, described with reference to FIG. 1 disposed at the opposite ends of the curtain 6 along the top edge thereof and each of the curtains 6 is controlled by a bead string 3. As mentioned previously, the carrier slides 100 are slidable along the track 4 by the control of the bead string 3 to move the curtain 6 along the track 4 so as to open/close the curtain 6.

The curtain carrier slide structure 100 also comprises release means 5 which is in the form of a block securely fixed on the track 4, having inclined camming surfaces formed on the opposite ends thereof so that when the carrier slide 100 is moved by the bead string 3 to pass over the release block 5, the camming surfaces of the release block 5 enter the upper recesses 11 and acting upon the slidable block 2 to move the slidable block 2 against the biasing springs 7 toward the bottom side of the hollow body 1 so as to release the engagement between the bead gap 32 of the bead string 3 and the end walls 13 of the hollow body 1. This disengages the carrier slide 100 from the bead string 3 and thus allowing the carrier slide 100 and thus the curtain 6 attached thereto to be retained with the release block 5.

As shown in the drawings, for each of the carrier slides 100, there is a release block 5 corresponding thereto securely mounted on the track 4. In the embodiment illustrated in FIGS. 2-5, there are four release blocks 5 secured on the track 4, two on the two opposite ends of the track 4 and two located substantially at the center of the track 4. In the embodiment, each of the curtains 6 has a width shorter than half the length of the track 4 or the distance between one side release block 5 and the corresponding center release block 5.

Figure 2:
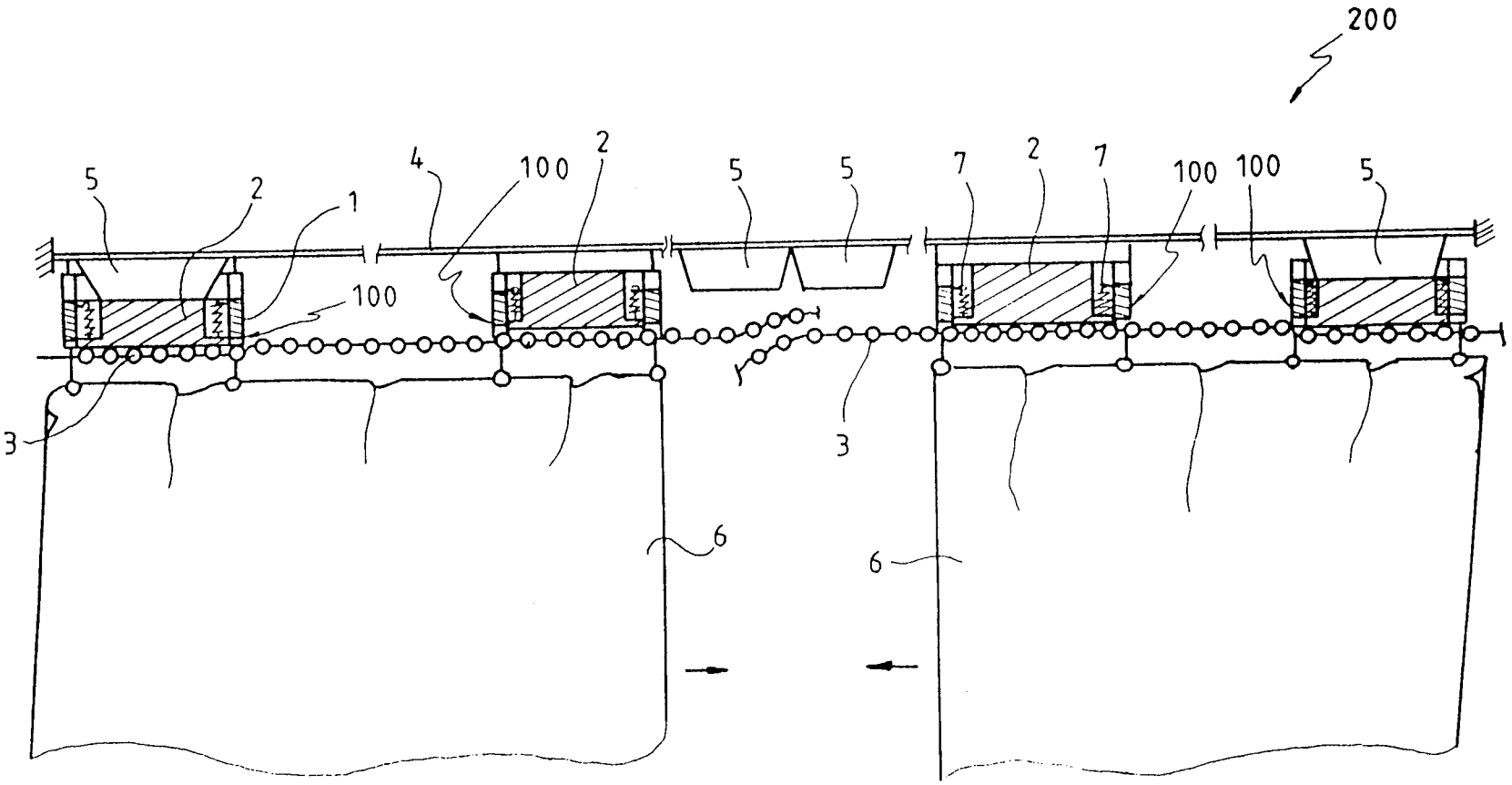
FIG. 2 is a front side view showing a curtain assembly adopting the curtain carrier slide of the present invention moved in a center-ward direction to close the curtain from the lateral sides to the center of a window.

As shown in FIG. 2, when the curtains 6 are moved from the opposite ends of the track 4 toward the center thereof and the bead strings 3 move the center carrier slides 100 toward the center of the track 4, the bead strings 3 will also move the side carrier slides 100 if the side carrier slides 100 are not engaged by the side release blocks 5 or the curtains 6 will be completely opened and the fully expanded curtains 6 will move the side carrier slides 100 out of the side release blocks 5 due to the fact that the curtains 6 are shorter than the distance between the side release blocks 5 and the center release blocks 5 if the side carrier slides 100 are originally engaged by the side release blocks 5.

Figure 3:
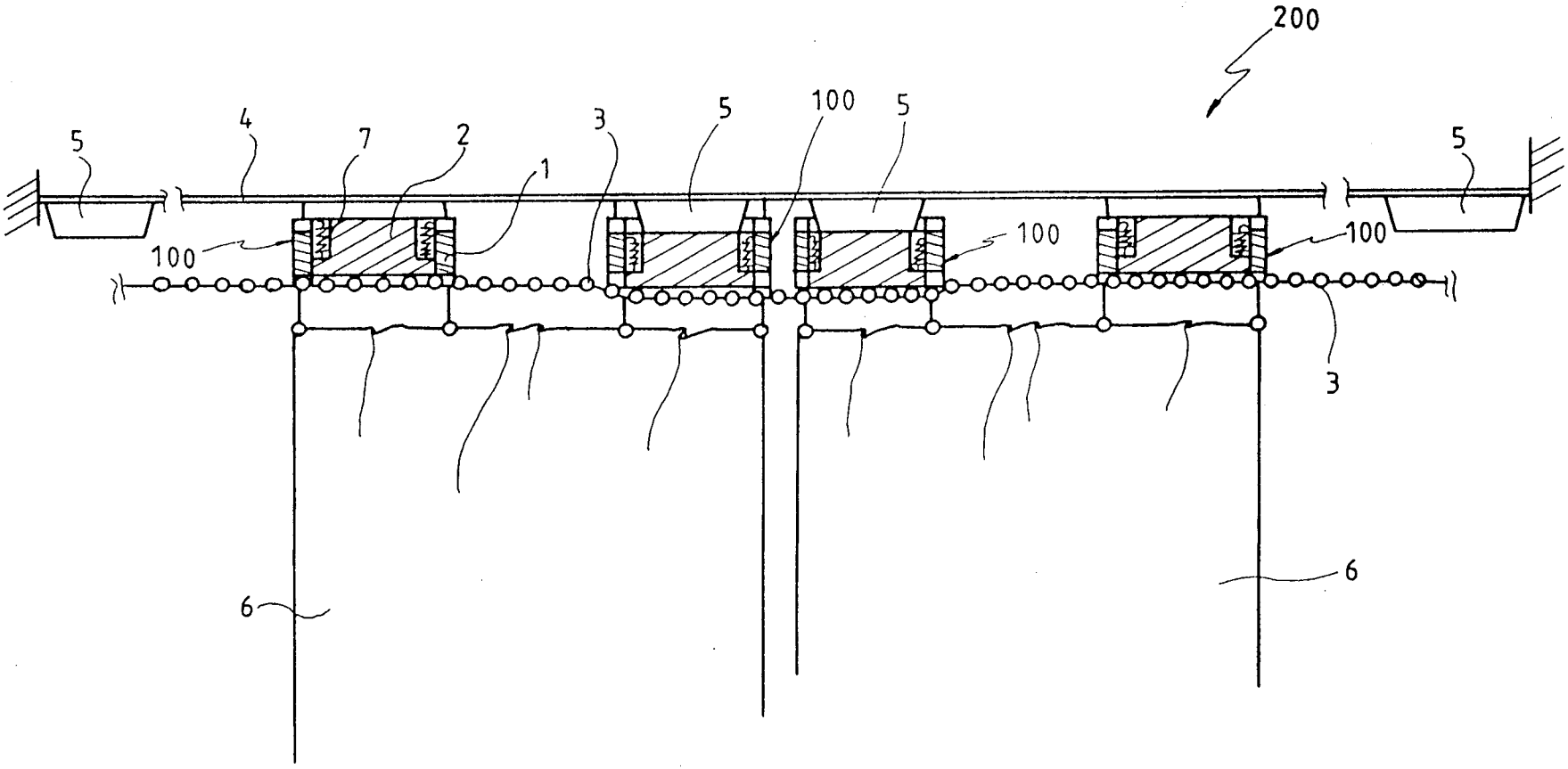
FIG. 3 is a front side view showing the curtain assembly adopting the curtain carrier slide of the present invention moved to and located at the center of the window.

As the center carrier slides 100 come into engagement with the center release blocks 5 to be retained thereby, as shown in FIG. 3, further pulling the bead strings 3 toward the center of the track 4 allows the curtains 6 to converge to the center by moving the side carrier slides 100 toward the center of the track 4 by the bead strings 3.

Figure 4:
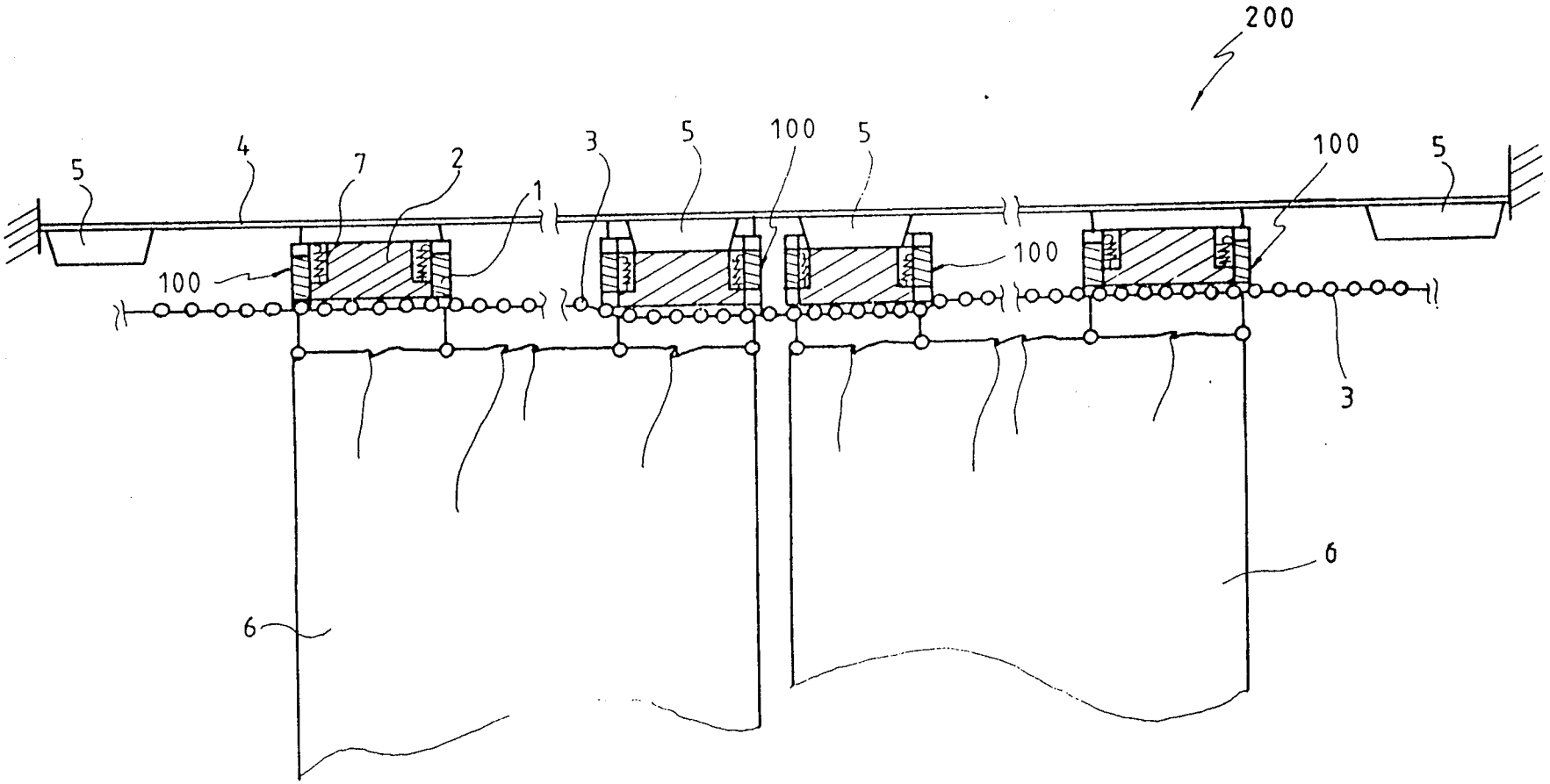
FIG. 4 is a front side view showing the curtain assembly adopting the curtain carrier slide of the present invention moved in a side-ward direction to close the curtain from the center to the lateral sides of the window.
Figure 5:
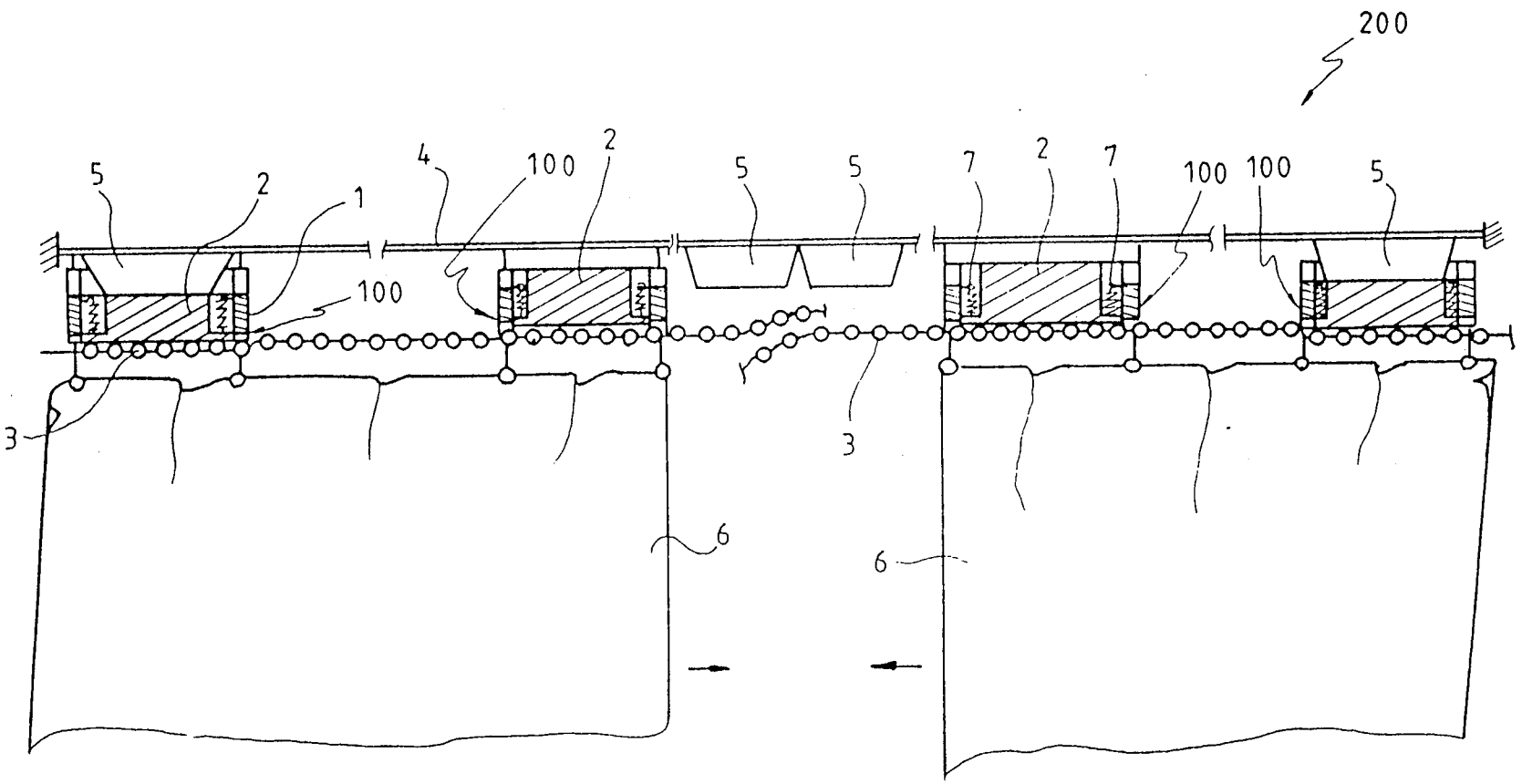
FIG. 5 is a front side view showing the curtain assembly adopting the curtain carrier slide of the present invention moved to and located at the lateral sides of the window.

In FIG. 4, the curtains 6 are moved from the center of the track 4 toward the opposite ends thereof The movement is an exact reversal of that shown in FIG. 2. As a result of the movement toward the opposite ends of the track 4, the curtains 6 are fully expanded from the center of the track 4, as shown in FIG. 5. Further pulling the bead strings 3 will bring the curtains to converge to the opposite ends of the track 4.

With such an arrangement of the curtain assembly 200 and the structure of the carrier slides 100, the curtains 6 can be opened or closed from either the center or the opposite ends of the track 4 and can converge to either the center or the opposite ends of the track 4.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. In a curtain assembly comprising an elongated track having a first position and a second position along the length thereof and at least a curtain which has a width shorter than a section of the length of said track and is slidably attached to said track by a number of carrier slides which are movable along the track, said carrier slides having a structure comprising for each of said carrier slides a hollow body having an open top and bottom sides to slidably receive therein a slidable block which is spring-biased toward the top side of the hollow body, said hollow body being slidably mounted to said track to be movable along the length thereof, said hollow body having two opposite end walls each having an upper recess and a lower recess formed thereon, a bead string having a length with a number of beads secured therealong to define bead gaps between the beads, each of said bead gaps being large enough to receive therein one of the end walls so that when said bead string is disposed within said upper recess to have the end walls received within and engaged by the bead gaps of said bead string, said hollow body is movable in unison with said bead string along the length of the track to move said curtain between the first and the second positions along said track, a release block corresponding to each of said carrier slides being securely mounted to said track, said release block being receivable within the upper recesses of said hollow body and having inclined camming surface opposing said slidable block so that when said carrier slide is moved by said bead string along the length of the track to pass over said release block and thus receiving said release block into the upper recesses of said hollow body, the camming surface of said release block pushes the slidable block against the biasing spring toward the bottom side of said hollow body to release the bead string out of engagement with the lower recesses of said hollow body.

2. A curtain assembly as claimed in claim 1, comprising two curtains each having a length shorter than half the length of said track, each curtains having two carrier slides respectively attached at two opposite sides thereof and each of said carrier slides having a release block corresponding thereto mounted on said track, said release blocks being respectively mounted at the first and the second position of said track in a symmetrical manner to allow the curtain to be movable from either the first position to the second position or from the second position to the first position.

* * * * *